US008714367B2

(12) United States Patent
Schulman

(10) Patent No.: US 8,714,367 B2
(45) **Date of Patent: *May 6, 2014**

(54) DESKTOP ORGANIZER

(76) Inventor: Carl H. Schulman, La Quinta, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/324,474

(22) Filed: Dec. 13, 2011

(65) Prior Publication Data

US 2012/0080390 A1 Apr. 5, 2012

Related U.S. Application Data

(63) Continuation of application No. 12/651,853, filed on Jan. 4, 2010, now Pat. No. 8,074,811, which is a continuation of application No. 11/550,772, filed on Oct. 18, 2006, now Pat. No. 7,641,056.

(60) Provisional application No. 60/730,214, filed on Oct. 25, 2005.

(51) Int. Cl.
*B42F 17/00* (2006.01)

(52) U.S. Cl.
USPC ..... 211/11

(58) Field of Classification Search
USPC ..... 211/10, 11, 13.1, 71.01, 94.01, 113, 211/123, 186, 189, 195, 204, 206; 108/50.01, 50.02, 97, 98, 108, 158.13; 248/220.21, 220.31, 222.12, 228.1, 248/228.6, 229.15, 229.25, 231.71; 312/196

See application file for complete search history.

(56) References Cited

U.S. PATENT DOCUMENTS

| | | | | |
|---|---|---|---|---|
| 543,025 | A * | 7/1895 | Knopf | 211/204 |
| 909,255 | A * | 1/1909 | Thackston | 280/79.3 |
| 1,495,189 | A | 5/1924 | Mack | |
| 1,671,293 | A | 5/1928 | Jennens | |
| 2,981,583 | A | 4/1961 | Eisenberg | |
| 3,517,822 | A | 6/1970 | Wagner | |
| 3,532,318 | A | 10/1970 | Llyod | |
| 4,034,864 | A | 7/1977 | Tyson et al. | |
| 4,099,521 | A * | 7/1978 | Nestor et al. | 600/228 |
| 4,126,304 | A * | 11/1978 | Barck | 269/73 |
| 4,176,743 | A | 12/1979 | Fitzpatrick | |
| 4,518,089 | A * | 5/1985 | Campbell | 211/118 |
| 4,542,832 | A | 9/1985 | Minick et al. | |
| 4,548,391 | A * | 10/1985 | Loban | 269/47 |
| D281,299 | S | 11/1985 | Esslinger | |
| 4,586,618 | A | 5/1986 | Norman | |
| 4,606,523 | A | 8/1986 | Statz et al. | |
| 4,612,863 | A | 9/1986 | Vonhausen et al. | |
| 4,802,593 | A | 2/1989 | Romanos | |
| 4,828,120 | A | 5/1989 | Beil et al. | |

(Continued)

FOREIGN PATENT DOCUMENTS

| | | |
|---|---|---|
| CN | 2640770 | 9/2004 |
| WO | 03029023 | 4/2003 |

*Primary Examiner* — Joshua Rodden

(74) *Attorney, Agent, or Firm* — The Belles Group, P.C.

(57) ABSTRACT

An organizer for a desk or other surface. In one aspect, the invention can be an organizer for a surface including: an elongated base assembly including a clamping member and a cover member for attaching to the surface; at least one fastening device for attaching the clamping member to the surface and for attaching the cover member to the clamping member; a pair of vertical supports attached to the cover member by the fastening device; and a plurality of horizontal rods extending between the pair of vertical supports.

19 Claims, 10 Drawing Sheets

(56) References Cited

U.S. PATENT DOCUMENTS

| | | | | | |
|---|---|---|---|---|---|
| 4,836,403 | A | | 6/1989 | Blackmon | |
| D309,839 | S | | 8/1990 | Newhouse | |
| D309,848 | S | | 8/1990 | Sokolski et al. | |
| D311,829 | S | | 11/1990 | Vossoughi | |
| D311,833 | S | | 11/1990 | Newhouse | |
| D318,269 | S | | 7/1991 | Hassel et al. | |
| 5,031,783 | A | | 7/1991 | Goudreau | |
| D321,011 | S | | 10/1991 | Blossom | |
| 5,197,614 | A | | 3/1993 | Dalton et al. | |
| D342,173 | S | | 12/1993 | Kirchner et al. | |
| 5,335,797 | A | | 8/1994 | Myers | |
| D351,860 | S | | 10/1994 | Kirchner et al. | |
| D353,159 | S | | 12/1994 | Kirchner et al. | |
| D363,492 | S | | 10/1995 | Brussing | |
| 5,482,168 | A | * | 1/1996 | Welch et al. | 211/106 |
| 5,547,088 | A | | 8/1996 | Belokin et al. | |
| 5,601,193 | A | | 2/1997 | Santoya | |
| 5,609,112 | A | * | 3/1997 | Meyer et al. | 108/158.13 |
| 5,632,384 | A | * | 5/1997 | Belanger et al. | 211/10 |
| 5,775,521 | A | | 7/1998 | Tisbo | |
| 5,911,178 | A | | 6/1999 | Alexander | |
| 5,961,191 | A | * | 10/1999 | Taylor | 312/34.8 |
| 5,971,171 | A | | 10/1999 | Thorp et al. | |
| 5,974,985 | A | | 11/1999 | Flototto et al. | |
| 6,119,992 | A | | 9/2000 | Stuart | |
| 6,152,311 | A | | 11/2000 | German | |
| 6,170,410 | B1 | | 1/2001 | Gioacchini et al. | |
| D445,456 | S | | 7/2001 | Saylor et al. | |
| 6,267,338 | B1 | * | 7/2001 | Saylor et al. | 248/200 |
| 6,302,366 | B1 | * | 10/2001 | Saylor et al. | 248/452 |
| 6,332,407 | B1 | | 12/2001 | Vardaro | |
| D453,794 | S | | 2/2002 | Saylor et al. | |
| D456,182 | S | | 4/2002 | Hamilton et al. | |
| 6,387,047 | B1 | * | 5/2002 | Duhaylongsod et al. | 600/231 |
| 6,435,461 | B1 | | 8/2002 | Saylor et al. | |
| 6,550,875 | B1 | | 4/2003 | Compton et al. | |
| 6,568,335 | B2 | | 5/2003 | Hamilton et al. | |
| 6,578,498 | B1 | | 6/2003 | Draudt et al. | |
| 6,648,390 | B1 | | 11/2003 | Yang | |
| 6,766,912 | B1 | | 7/2004 | Gibbs | |
| 6,792,876 | B2 | | 9/2004 | Lin | |
| 6,968,957 | B2 | | 11/2005 | Fynn | |
| 7,121,030 | B2 | | 10/2006 | Schneider | |
| 7,185,767 | B2 | | 3/2007 | Phillips | |
| 7,273,152 | B1 | | 9/2007 | Kahn | |
| 7,357,086 | B2 | | 4/2008 | Petrick et al. | |
| D589,728 | S | | 4/2009 | Shana et al. | |
| 7,641,056 | B2 | | 1/2010 | Schulman | |
| 2004/0035332 | A1 | * | 2/2004 | Lin | 108/50.01 |
| 2005/0098069 | A1 | | 5/2005 | Mills et al. | |

* cited by examiner

DESKTOP ORGANIZER

CROSS-REFERENCE TO RELATED APPLICATIONS

The present application is a continuation of U.S. patent application Ser. No. 12/651,853, filed Jan. 4, 2010, which is issued as U.S. Pat. No. 8,074,811, which in turn is a continuation of U.S. patent application Ser. No. 11/550,772, filed Oct. 18, 2006, now issued as U.S. Pat. No. 7,641,056, which in turn claims the benefit of U.S. Provisional Patent Application Ser. No. 60/730,214, filed Oct. 25, 2005, the entireties of which are hereby incorporated herein by reference.

FIELD OF THE INVENTION

The present invention relates in general to a desktop organizer, and, more particularly, to a desktop organizer attached to a desk and capable of holding a multitude of items that normally clutter up a desk.

BACKGROUND OF THE INVENTION

This section describes the background of the disclosed embodiment of the present invention. There is no intention, either express or implied, that the background art discussed in this section legally constitutes prior art.

Many people work at desks that are cluttered with so much stuff that they have very little working space. The desktop may contain a computer monitor, a keyboard, a mouse, other computer related items, a telephone, in/out baskets, books, files, notepads, pens, pencils, a stapler, and other office supplies. Some desktop organizers provide a place to put some of these items, but they rest on the desktop consuming valuable work space. Other organizers are mounted on a wall, but not all desks are located close enough to a wall for the organizer to be convenient.

A few desktop organizers are attached to the desktop and provide storage above the desktop. Some of these organizers require damaging the desktop, such as drilling a hole in or driving a screw into it, to mount them to the desktop. Other organizers include a pair of legs that are clamped to an overhanging portion of the desktop to support the organizing device. These organizers are very limited in the amount of material that can be stored on them due to this method of support.

SUMMARY OF THE INVENTION

The present invention solves these and other needs by providing a desktop organizer that is able to store a significant amount of material and that takes up minimal desk space. In one aspect, the invention can be an organizer comprising: a rack assembly comprising a pair of spaced-apart vertical supports and a plurality of horizontal rods extending between and supported by the pair of vertical supports, the plurality of horizontal rods arranged in a spaced-apart manner; an organization accessory having a rear side having a width that is greater than a distance between the vertical supports, the organization accessory having a pair of hook members extending from the rear side of the organization accessory; and the organization accessory mounted to the rack assembly so that the hook members engage one of the horizontal rods and the rear side of the organization accessory rests against the pair of vertical supports.

In another aspect, the invention can be an organizer secured to a desired surface having an extending portion comprising:

a base assembly comprising: a clamping member having a channel, the extending portion of the desired surface slidably inserted into the channel of the clamping member; an adjustable fastener extending into the channel that compresses the extending portion of the desired surface against the clamping member; and a cover member coupled to the clamping member and having a rear portion, a forward portion and a channel in the rear portion, the cover member positioned atop the desired surface so that a portion of the clamping member nests within the channel of the cover member and the forward portion of the cover member contacts the desired surface to prevent the organizer from leaning forward; and a rack assembly connected to and extending upward from the base assembly.

In yet another aspect, the invention can be an organizer for a surface comprising: an elongated base assembly including a clamping member and a cover member for attaching to the surface; at least one fastening device for attaching the clamping member to the surface and for attaching the cover member to the clamping member; a pair of vertical supports attached to the cover member by the fastening device, each vertical support including a plurality of holes; and a plurality of horizontal rods extending from the holes in one of the vertical supports to the corresponding holes in the other vertical support.

In a further aspect, the invention can be an organizer secured to a desired surface having an extending portion comprising: a base assembly comprising: a clamping member having a channel, the extending portion of the desired surface slidably inserted into the channel of the clamping member; and a cover member having a rear portion, a forward portion and a channel in the rear portion, the cover member positioned atop the desired surface so that a portion of the clamping member nests within the channel of the cover member, the forward portion of the cover member having a bottom surface that contacts the desired surface to prevent the organizer from leaning forward; and the forward portion of the cover member having a curved top surface forming a well; and a rack assembly connected to the base assembly and extending upward from the rear portion of the cover member.

In a still further aspect, the invention can be an organizer for a desktop comprising: an elongated base member; at least one fastening device for attaching the elongated base member to the desktop; a pair of vertical supports adapted to be attached to the base member; a plurality of rods attached to the vertical supports; and at least one organizing accessory having a pair of hooks for hanging the accessory from one of the rods.

In still another aspect, the invention can be an organizer for a surface comprising: an elongated base assembly including: an affixing assembly configured to affix the organizer to the surface; and a cover member comprising a space in which at least a portion of the affixing assembly nests; a pair of supports attached to and extending upward from the cover member; and a plurality of rods extending between the pair of supports.

BRIEF DESCRIPTION OF THE DRAWINGS

The features of this invention and the manner of attaining them will become apparent, and the invention itself will be best understood by reference to the following description of certain embodiments of the invention taken in conjunction with the accompanying drawings, wherein.

DETAILED DESCRIPTION OF THE INVENTION

Figure 1:
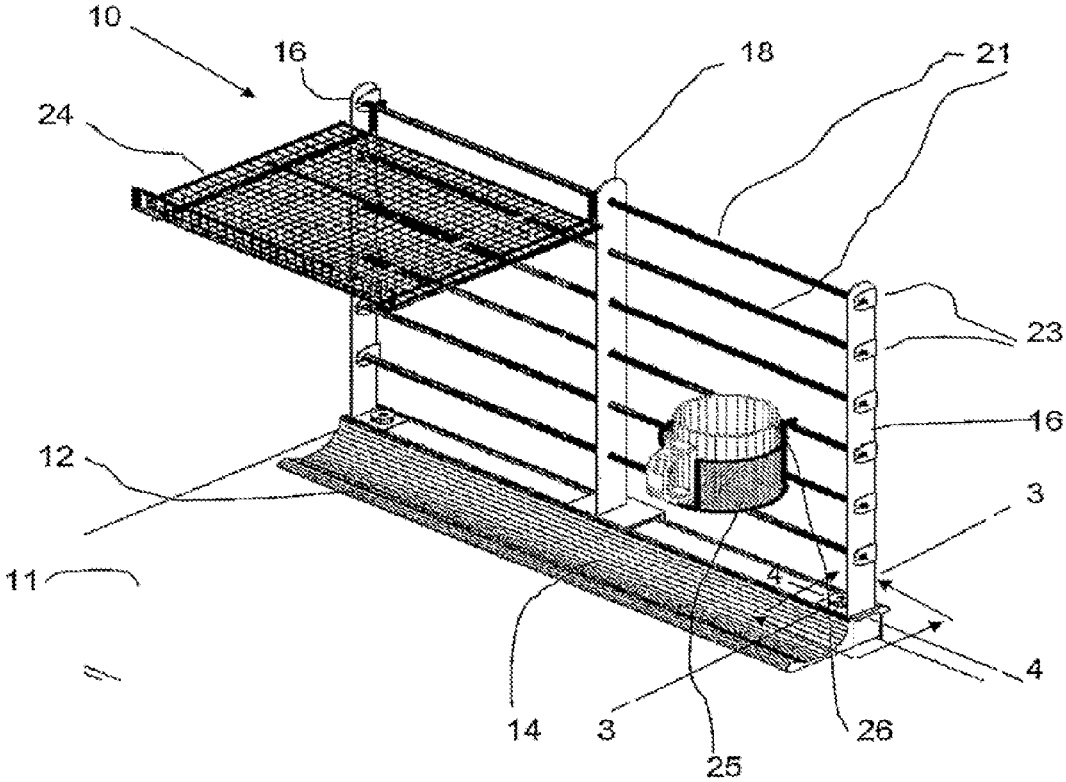
FIG. 1 is a perspective view of an embodiment of the desktop organizer of the present invention mounted on a desktop.

It will be readily understood that the components of the embodiments as generally described and illustrated in the drawings herein, could be arranged and designed in a wide variety of different configurations. Thus, the following more detailed description of the embodiments of the system, components and method of the present invention, as represented in the drawings, is not intended to limit the scope of the invention, as claimed, but is merely representative of certain embodiments of the invention.

An embodiment of an organizer for a desk or other horizontal surface having an extending portion includes an elongated base assembly having a clamping member and a cover member for attaching to the extending portion, at least one fastening device for attaching the clamping member to the surface and for attaching the cover member to the clamping member, a pair of vertical supports adapted to be attached to the cover member and each support including a plurality of holes, and a plurality of horizontal accessory supporting rods extending from the holes in one of the vertical supports to the corresponding holes in the other vertical support.

According to another embodiment of the invention, there is provided an organizer for a desk having an extending desktop portion. The organizer may include an elongated base member, at least one fastening device for attaching the elongated base member to the extending desktop portion, a pair of vertical supports adapted to be attached to the base member, a plurality of rods attached to the vertical supports, and at least one organizing accessory having a pair of hooks for hanging the accessory from one of the rods.

According to yet another embodiment of the invention, there is provided an organizer for a surface having an extending portion. The organizer may include a pair of vertical supports adapted to be attached to the extending desktop portion, a plurality of rods attached to the vertical supports, and at least one organizing accessory having a pair of hooks for hanging the accessory from one of the rods.

Referring now to FIG. 1 of the drawings, there is shown a perspective view of a desk organizer in accordance with an embodiment of the present invention. The desk organizer 10 may include a base assembly 12 attached to a desktop 11. The base assembly 12 may support a pair of end vertical supports 16 and a center vertical support 18.

Figure 5:
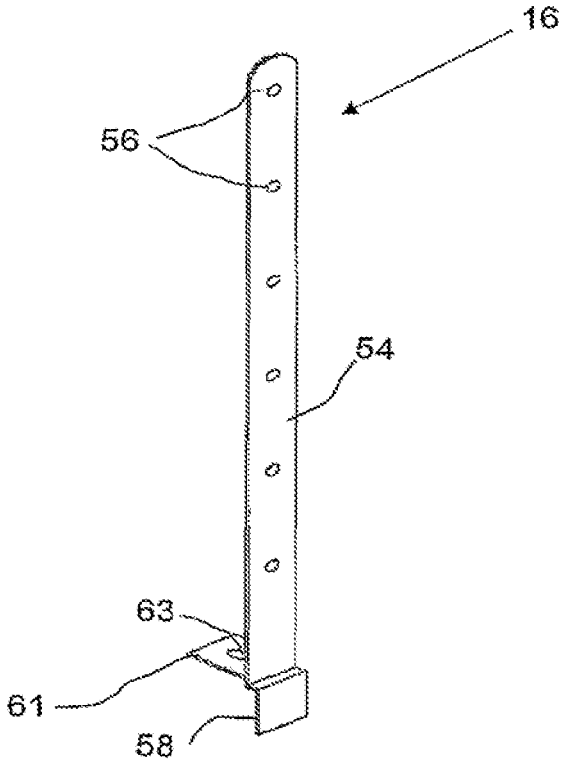
FIG. 5 is a perspective view of the end vertical support of the desktop organizer of FIG. 1.
Figure 6:
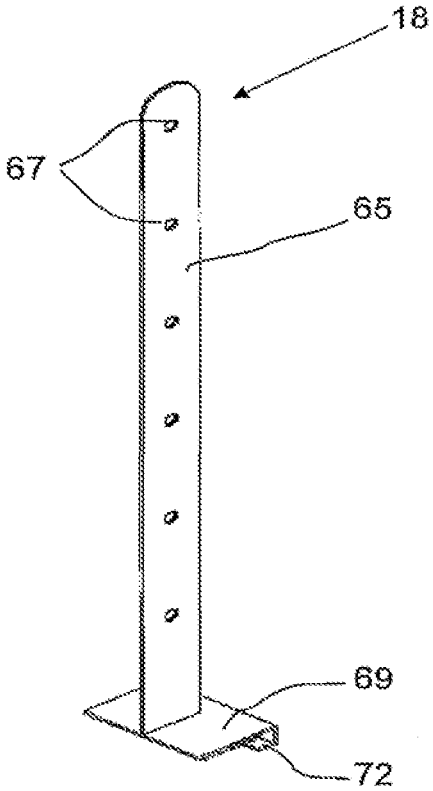
FIG. 6 is a perspective view of the center vertical support of the desktop organizer of FIG. 1.

As shown in FIG. 5, the end vertical support 16 may include a vertical member 54 having a plurality of evenly-spaced holes 56, an offset member 58, and a horizontal tab 61 having an elongated hole 63. As shown in FIG. 6, the center vertical support may include a vertical member 65 having a plurality of evenly spaced holes 67 and a base 69 having a hook portion 72.

The end vertical supports 16 and center vertical support 18 may support a plurality of parallel rods 21 for attaching organizing accessories. The rods 21 may be positioned through the corresponding holes 56 and 67 in end vertical supports 16 and center vertical support 18, respectively, and secured to the end vertical supports 18 with a plurality of retainer clips 23. The organizing accessories may include a shelf 24 and a cup holder 25 for holding a cup 26. Various other organizing accessories may include, but are not limited to, a letter holder, a file sorter, a book/magazine holder, a basket, an organizer basket, a CD holder, and a pencil holder.

Depending upon the overall length of the desk organizer and the accessories utilized (i.e. weight to be supported), the center vertical support may not be necessary. The length of the desk organizer may vary from less than one foot to greater than two feet. Multiple desk organizers may be used together to increase the storage capabilities. The desk organizer may also used with any other horizontal surface, not only a desktop, where additional storage is desired.

Figure 2:
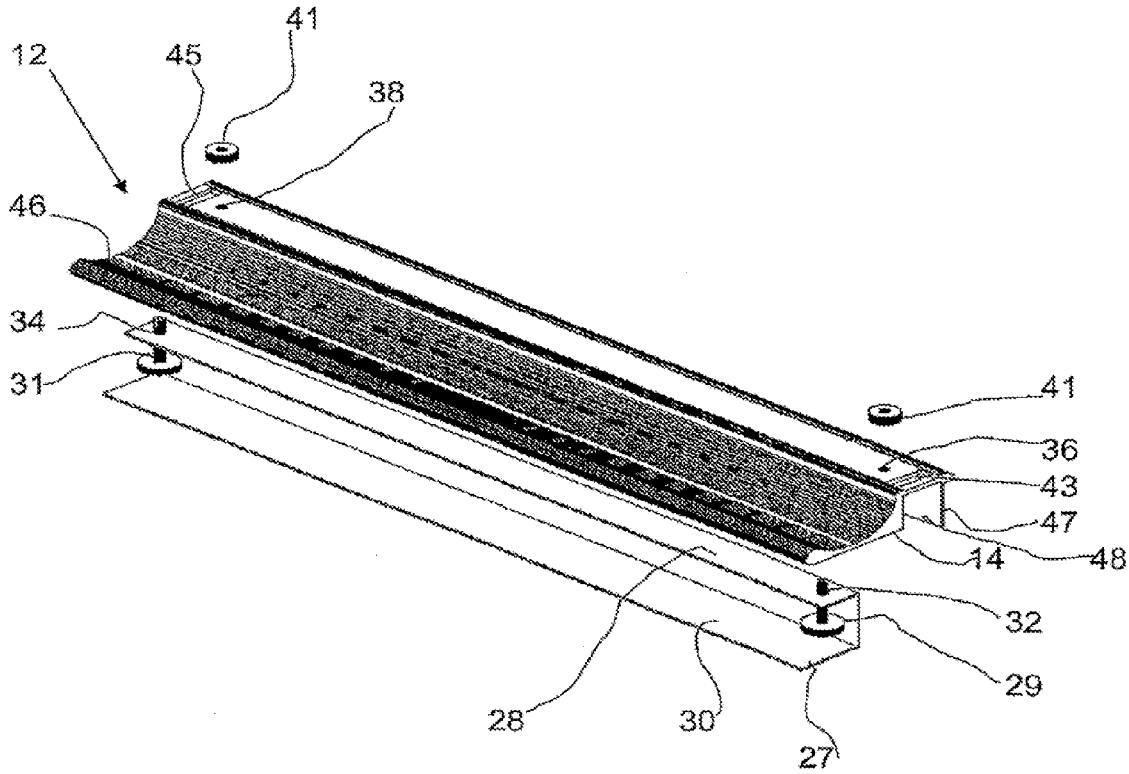
FIG. 2 is an exploded view of the base assembly of the desktop organizer of FIG. 1.

Referring now to FIG. 2, there is shown an exploded view of the base assembly 12. The base assembly 12 may include an affixing member, shown in the figure as a clamping member 27, that attaches to the desk and a cover member that attaches to the clamping member 27 on the desktop. The clamping member 27 may include an upper horizontal portion 28 and a lower horizontal portion 30. Elevator bolts 29 and 31 may extend through holes 32 and 34, respectively, in the upper horizontal portion 28 of the clamping member 27 and holes 36 and 38, respectively, in the cover member 14 to allow the clamping member 27 to be attached to the desk and the cover member 14 to be attached to the clamping member 27 using nuts 41 (also known as cover nuts 41), such as acorn nuts or other suitable nuts. Other bolts having a large flat bottom surface may be used in place of the elevator bolts. The cover member 14 may further include openings 43 and 45 for the insertion of a portion of the end vertical supports.

Figure 3:
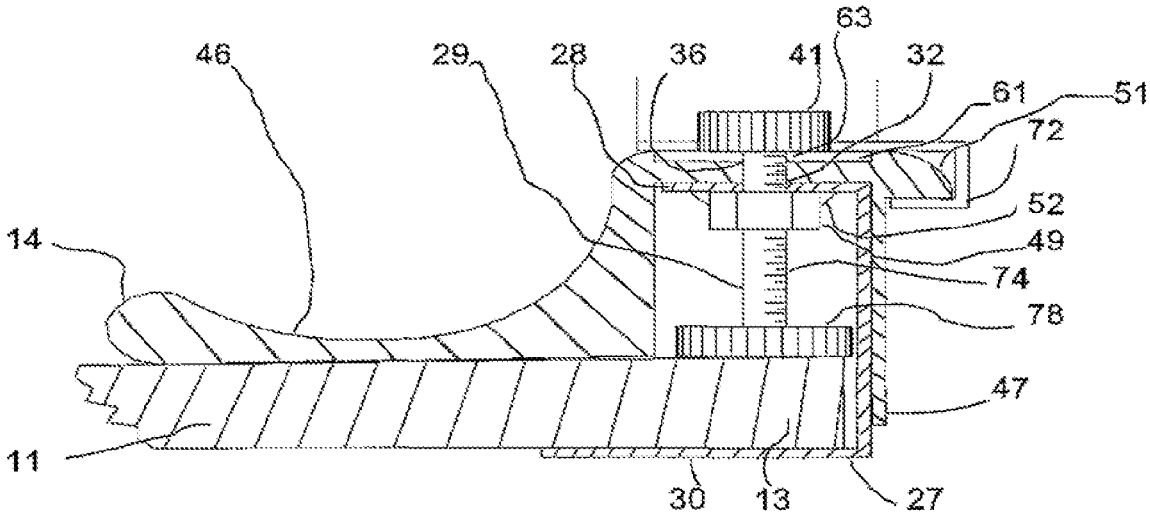
FIG. 3 is a sectional view of the base assembly through line 3-3 of FIG. 1.
Figure 4:
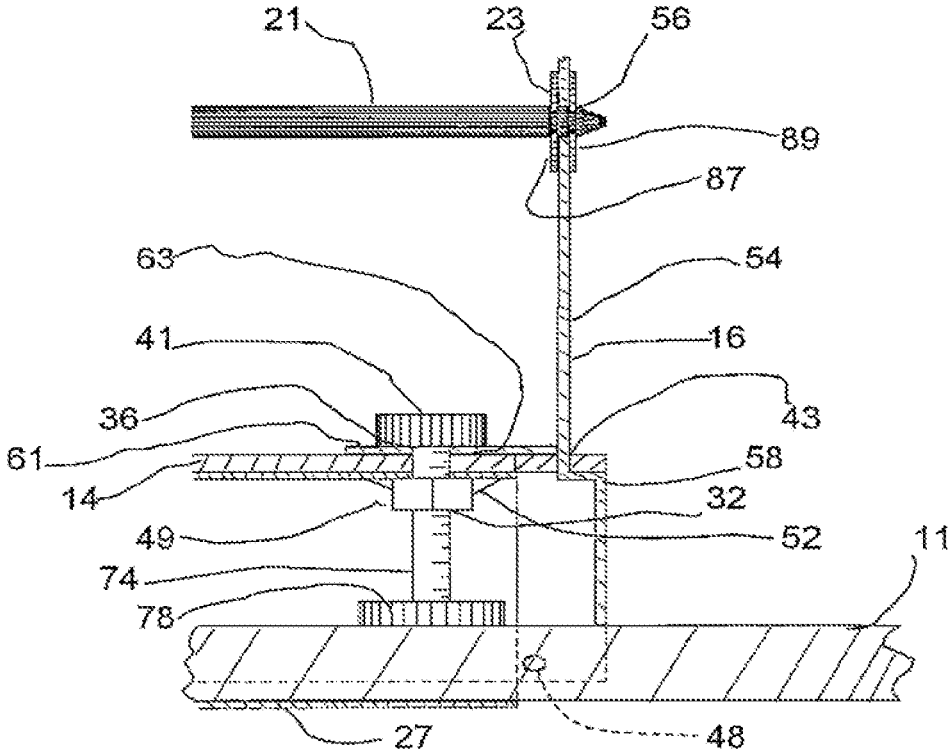
FIG. 4 is a sectional view of the base assembly through line 4-4 of FIG. 1.
Figure 9:
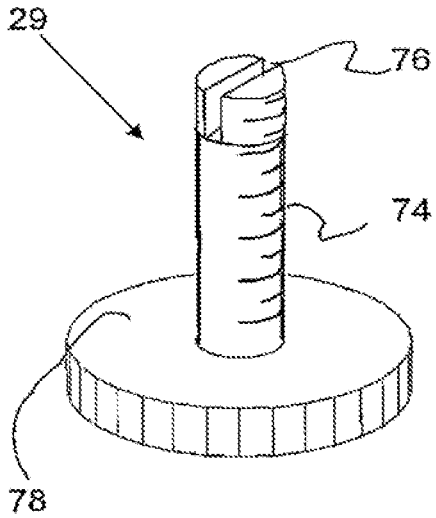
FIG. 9 is a perspective view of the elevator bolt of the base assembly of FIG. 2.

Referring now to FIGS. 3 and 4, there are shown sectional views of the base assembly 12 of FIG. 1. The clamping member 27 may be attached to an extending portion 13 of desktop 11 using the elevator bolt 29, which may include a threaded portion 74, a base 78, and a slotted top 76 (FIG. 9). A nut 49 may be welded to the bottom side of the upper horizontal portion 28 around the hole 32 for engaging the threaded portion 74 of elevator bolt 29 to allow the tightening of base 78 to the extending portion 13 of the desktop 11.

An upper portion of the elevator bolt 29 including the slotted end may extend through the hole 36 in the cover member 14 and an elongated hole 63 in a horizontal tab 61 on the end vertical support 16 (FIG. 5). The nut 41 may secure the cover member 14 and the end vertical support 16 to the clamping member 27.

A front portion 46 of the cover member 14 may include a well for storing pens, pencils, or other small desk items and may provide additional support to prevent the desk organizer from leaning forward when holding a substantial load. A back portion 47 of the cover member 14 may extend down farther than the top of the desktop 11 to conceal a substantial part of the clamping member 27. An extending lip 51 along the back of the cover member 14 may engage a hook portion 72 of the center vertical support 18. The back portion 47 may include at least one hole or opening 48 to receive a screw or other fastening device (not shown) to fix the portion 47 to the desktop 11. In this manner, optionally the clamping member need not be employed.

The offset member 58 of the end vertical support 16 may be inserted through the opening 43 in the cover member 14 to dispose the horizontal tab 61 adjacent to the top of the cover member 14 with the elevator bolt extending through the elongated hole 63 in the horizontal tab 61. The offset member 58 may cover an open side of the cover member at least partially concealing the clamping member 27 and elevator bolt 29.

Figure 7:
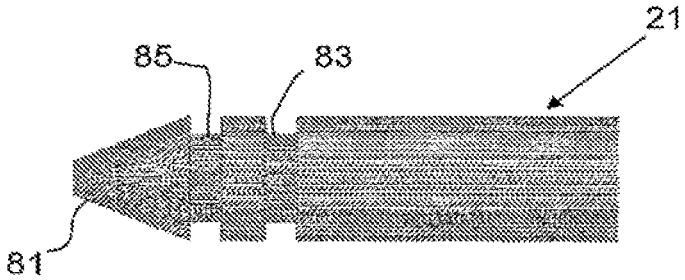
FIG. 7 is a partial enlarged view of one of the rods of the desktop organizer of FIG. 1.
Figure 8:
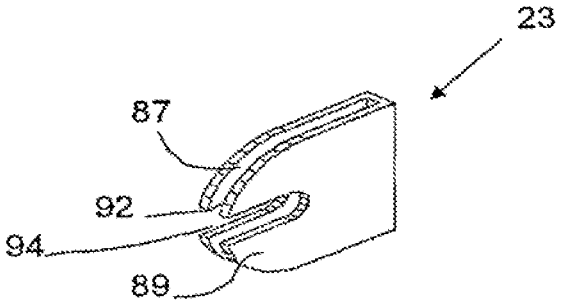
FIG. 8 is a perspective view of one of the clips used to hold the rods to the end vertical supports of the desktop organizer of FIG. 1.

One of the rods 21 may be inserted through one of the holes 56 in the vertical member 54 of the end support rod 16. The rod 21 may be secured to the vertical member 54 using sides 87 and 89 of one oldie retainer clips 23. As shown in FIG. 7, each end 81 of the rod 21 may include a pair of grooves 83 and 85. The grooves 83 and 85 may be engaged with the slots 92 and 94 in the sides 87 and 89, respectively, of the retainer clip 23 as shown in FIG. 8.

Figure 10:
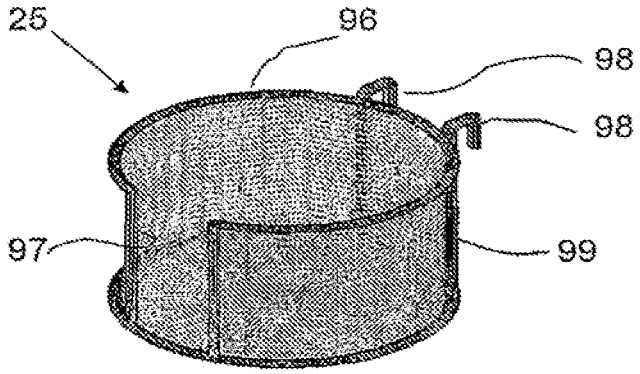
FIG. 10 is a perspective view of the cup holder shown in FIG. 1.

Referring now to FIG. 10, there is shown a perspective view of one of the organizing accessories. The cup holder accessory 25 may include a cylindrical body 96 having a cup handle opening 97 to allow accommodation of a cup with a handle as shown in FIG. 1. A pair of hooks 98 may be attached to the back of the cylindrical body 96 to allow attachment of the cup holder accessory 25 to one of the rods 21 of the desktop organizer 10.

Each organizing accessory may include a pair of hooks. If the width of the accessory is less than the distance between adjacent vertical supports (i.e. the cup holder accessory 25 in FIG. 1), the hooks may each include a vertical rod portion 99 having a length which may be greater than the distance between two adjacent horizontal rods to hold the accessory in an upright position. Alternatively, at least one vertical member (not shown) separate from the hooks may be employed to serve the same function as the hook portions 99. If the width of the accessory is greater than the distance between adjacent vertical supports (i.e. the shelf accessory 24 in FIG. 1), the length of the hooks may be less than the distance between two adjacent rods since the vertical supports may hold the accessory in an upright position.

To install the desktop organizer 10, the clamping member 27 may be disposed around any extending portion of a desktop 11. The bases of the elevator bolts 29, 31 may be lowered using a screwdriver in the slotted top to firmly clamp the desktop 11 between the lower horizontal member 30 of the clamping member 27 and the bases of the elevator bolts 29, 31. The cover member 14 may then be placed over the clamping member 27 with the slotted tops of the elevator bolts 29, 31 extending through the holes 36, 38 in the cover member 14.

The offset members 58 of the end vertical supports 16 may next be inserted through the openings in the cover member 14, so that the offset members 58 may cover the open sides of the cover member 14 and the horizontal tabs 61 may be adjacent to the top of the cover member 14 with the slotted tops extending through the elongated holes 63 in the horizontal tabs 61. A nut 4.1 may be used on each extending top of the elevator bolts 29, 31 to secure the cover member 14 and the end vertical supports 16 to the clamping member 27. If, for example, the desk organizer 10 is approximately 24 inches long, a center vertical support 18 may be attached to the cover member 14 using a lip 51 on the back side of the cover member 14 and a hook portion 72 on the center vertical support 18.

A plurality of rods 21 may then be placed through the evenly spaced holes 56, 67 in the vertical supports 16, 18. The ends of the rods 21 including a pair of grooves 83, 85 may be secured to the end vertical supports 16 using a plurality of retainer clips 23 or other suitable method, such as rods with threaded ends used with nuts, to achieve a strong rigid connection. The rods 21 may also be permanently attached to the vertical supports 16 by welding or other appropriate method of attachment. The desired organizing accessories may now be installed on the parallel vertical rods.

The embodiment described above has the advantage of a sturdy base and sturdy vertical supports to allow much greater loads to be placed on the desktop organizer. Shelves on this organizer may be capable of holding twenty pounds or more in actual models which have been constructed and tested.

While particular embodiments of the present invention have been disclosed, it is to be understood that various different modifications and combinations are possible and are contemplated within the true spirit and scope of the disclosed embodiments. There is no intention, therefore, of limitations to the exact disclosure herein presented.

What is claimed is:

1. An organizer for a surface comprising:

an elongated base assembly including an affixing member configured to attach to the surface and a cover member configured to nest over the affixing member;

at least two fastening devices, each fastening device being configured to secure the affixing member to the surface and to attach the cover member to the affixing member;

a pair of vertical supports attached to the cover member by the fastening devices; and a plurality of horizontal rods extending between the pair of vertical supports.

2. The organizer of claim 1 further comprising a plurality of retainer clips for holding the rods to the vertical supports, and at least one organizing accessory having a pair of hooks for hanging the accessory from one of the rods, the surface being a desktop.

3. The organizer of claim 2 wherein the rods include at least one groove for mating with one of the retainer clips.

4. The organizer of claim 1 wherein the affixing member includes an upper portion having at least two holes, and a nut welded to a bottom side of the upper portion at each hole in the affixing member.

5. The organizer of claim 4 wherein each of the at least two fastening devices includes a bolt having a threaded portion and a base, the threaded portion of each bolt engages one of the nuts welded to the affixing member.

6. The organizer of claim 5 wherein the threaded portion of each of the bolts includes a slotted top.

7. The organizer of claim 6 wherein each of the slotted tops extends through a corresponding hole in the cover member and engages a cover nut for holding the cover member to the affixing member.

8. The organizer of claim 7 wherein each of the slotted tops extends through an elongated hole in a horizontal tab of one of the vertical supports and engages the cover nut for holding the vertical supports to the cover member.

9. The organizer of claim further including a center vertical support having a plurality of holes for supporting the rods.

10. The organizer of claim 2 wherein a portion of each hook extends from one of the rods to another one of the rods.

11. The organizer of claim 2 wherein the accessory extends from one of the vertical supports to the other one of the vertical supports.

12. An organizer for a surface comprising:

an elongated base assembly including:

an affixing assembly configured to affix the base assembly to the surface, the affixing assembly including at least two fastening members; and a cover member comprising a space in which at least a portion of the affixing assembly nests and a front portion configured to extend laterally along the surface, the cover member being, secured to the affixing assembly by the at least two fastening members;

a pair of supports extending upward from the cover member, each support being secured to the affixing assembly by one of the at least two fastening members; and a plurality of rods extending between the pair of supports.

13. The organizer of claim 12 wherein each fastening member includes a threaded portion extending through the cover member.

14. The organizer of claim 12 further comprising a plurality of retainer clips for holding the rods to the vertical supports, and at least one organizing accessory having a pair of hooks for hanging the accessory from one of the rods, the surface being a desktop.

15. The organizer of claim 12 wherein the affixing member includes an upper portion having at least two holes, and a nut welded to a bottom side of the upper portion at each hole.

16. The organizer of claim 15 wherein each fastening member includes a bolt having a threaded portion and a base, the threaded portion engaging, one of the nuts.

17. The organizer of claim 16 wherein the threaded portion of each fastening member includes a slotted top.

18. The organizer of claim 17 wherein the slotted top of each fastening member extends through a corresponding hole in the cover member and engages a cover nut for holding the cover member to the affixing member.

19. The organizer of claim 18 wherein the slotted top of each fastening member extends through an elongated hole in a horizontal tab of one of the vertical supports and engages the cover nut for holding one of the vertical supports to the cover member.

* * * * *